US007478961B1

(12) United States Patent
Raker

(10) Patent No.: US 7,478,961 B1
(45) Date of Patent: Jan. 20, 2009

(54) LOTION DISPENSER-APPLICATOR

(76) Inventor: Phyllis J. Raker, 529 S. Main St., Bellevue, IL (US) 61604

( * ) Notice: Subject to any disclaimer, the term of this patent is extended or adjusted under 35 U.S.C. 154(b) by 0 days.

(21) Appl. No.: 11/607,148

(22) Filed: Nov. 30, 2006

Related U.S. Application Data

(63) Continuation-in-part of application No. 11/243,763, filed on Oct. 5, 2005, now abandoned.

(60) Provisional application No. 60/616,712, filed on Oct. 6, 2004.

(51) Int. Cl.
*A46B 11/02* (2006.01)
*B43K 5/02* (2006.01)

(52) U.S. Cl. ..... 401/188 R; 401/187; 401/137; 401/139

(58) Field of Classification Search ..... 401/136–139, 401/261–266, 188 R, 187, 206, 205, 190; 222/383.1, 324, 385
See application file for complete search history.

(56) References Cited

U.S. PATENT DOCUMENTS

| | | | | |
|---|---|---|---|---|
| 2,147,769 | A * | 2/1939 | Epstein | 401/139 |
| 3,184,781 | A | 5/1965 | Hoxie | 15/552 |
| 4,004,854 | A | 1/1977 | Breer, II | 401/205 |
| 4,889,441 | A | 12/1989 | Tice | 401/131 |
| 4,902,155 | A | 2/1990 | Buschemeyer | 401/206 |
| 4,934,855 | A * | 6/1990 | Recchelbacher | 401/137 |
| 5,018,894 | A | 5/1991 | Goncalves | 401/202 |
| 5,885,019 | A * | 3/1999 | Stear | 401/137 |
| 6,099,184 | A * | 8/2000 | Koptis | 401/190 |
| 6,210,057 | B1 | 4/2001 | Yannaci et al. | 401/6 |
| 6,227,740 | B1 * | 5/2001 | Stear et al. | 401/188 R |
| 6,742,951 | B2 | 6/2004 | Schultz et al. | 401/139 |
| 2002/0018687 | A1 | 2/2002 | Owings | 401/6 |
| 2002/0071708 | A1 | 6/2002 | Fontanet et al. | 401/202 |
| 2003/0031501 | A1 | 2/2003 | Eadie | 401/290 |
| 2004/0101347 | A1 | 5/2004 | Beard | 401/139 |

OTHER PUBLICATIONS

Body Cream Applicator/Massager shown on p. 51 of Christmas 2003 catalog of *Solutions*, Portland, Oregon. Copy submitted in parent application. Date the product was first manufactured or sold is unknown, Oct. 21, 2003.

OXO Soap Dispensing Kitchen Brush shown in May 17-19, 2005, brochure of *The Container Store*, Coppell, Texas. Copy submitted in parent application. Date the product was first manufactured or sold is unknown May 18, 2005.

* cited by examiner

*Primary Examiner*—Khoa D Huynh
(74) *Attorney, Agent, or Firm*—Philip L. Bateman

(57) ABSTRACT

A lotion dispenser-applicator enables lotion to be applied to hard-to-reach parts of the body. The lotion dispenser-applicator contains an elongated handle for holding lotion, a planar face with a slot at the upper end of the handle, a porous pad covering the face with a void extending from the slot, a displacement pump at the upper end of the handle, a dip tube, and a dispensing spout. The distal end of the spout extends into the void of the pad. An orifice in the distal end of the spout is directed to dispense lotion not the exterior surface of the pad from which is it applied to the body.

5 Claims, 2 Drawing Sheets

LOTION DISPENSER-APPLICATOR

CROSS-REFERENCE TO RELATED APPLICATION

This application is a continuation-in-part of U.S. patent application Ser. No. 11/243,763, Oct. 5, 2005, which claimed the benefit of U.S. Provisional Patent Application Ser. No. 60/616,712, Oct. 6, 2004.

FIELD OF THE INVENTION

This invention relates to dispensers and applicators for lotions.

BACKGROUND OF THE INVENTION

A wide variety of lotions are applied to the body, including soaps, moisturizers, creams, sunscreens, gels, and the like. The term "lotion" is used herein to refer to fluids that are considerably thicker and more viscous than water. These lotions are frequently packaged in containers that include a displacement pump as a dispenser. A displacement pump features a spring-biased reciprocating head with a dip tube. When the head is depressed, the volume of the internal chamber of the pump is decreased and a corresponding volume of lotion is dispensed. When the head is released, the internal volume of the pump is increased and a corresponding volume of lotion is drawn into the dip tube.

Lotions are frequently applied to the body by hand. However, the middle of the back is very difficult for most people to reach with their own hands. Persons having physical disabilities can have difficulty reaching additional body parts. Lotion or soap dispenser-applicators having elongated handles have been produced. For example, a body cream applicator/massager is sold by Solutions of Portland, Oreg. The device contains a reservoir in the head that can be filled with the desired lotion. The amount of lotion that flows out of the device is not easily controlled. A soap dispensing kitchen brush is sold by OXO International of New York, N.Y. The device contains a reservoir in the handle. A button is pressed to dispense the liquid soap through bristles of the brush.

Two combined lotion dispenser-applicators having elongated handles with reservoirs have been disclosed in the patent literature. Yannaci et al., U.S. Pat. No. 6,210,057, Apr. 3, 2001, discloses a lotion dispenser-applicator that contains a reservoir in a portion of the handle. The lotion in the reservoir is forced to the applicator by a sliding, piston-like movement of a portion of the handle. Owings, U.S. Pat. Appln. Publn No. 2002/0018687, Feb. 14, 2002, also discloses a lotion dispenser-applicator that contains a reservoir in a portion of the handle. The lotion is forced to the applicator by squeezing a bulb. The Yannaci et al. and the Owings devices hold relatively small quantities of lotion and dispense variable amounts of lotion. Both devices force the lotion onto the interior surface of the applicator. The lotion then flows through the applicator to the exterior surface where it is applied to the body.

A variety of devices have been disclosed for dispensing and applying aqueous solutions and relatively low viscosity lotions using a porous pad made of cotton, sponge, synthetic foam, or the like. These devices fall into two general types.

The first type of device contains a nozzle or dispenser that applies the fluid to the interior surface of an integral pad. The fluid flows through the pad to the exterior surface. The pad is then rubbed onto the surface to be treated. Examples of this type of device include Hoxie, U.S. Pat. No. 3,184,781, May 25, 1965; Breer II, U.S. Pat. No. 4,004,854, Jan. 25, 1977; Tice, U.S. Pat. No. 4,889,441, Dec. 26, 1989; Buschemeyer, U.S. Pat. No. 4,902,155, Feb. 20, 1990; Goncalves, U.S. Pat. No. 5,018,894, May 28, 1991; Fontanet et al., U.S. Pat. Appln. Publn. No. 2002/0071708, Jun. 13, 2002; and Eadie, U.S. Pat. Appln. Publn. No. 2003/0031501, Feb. 13, 2003. The Yannaci et al. and Owings devices discussed above are similar to this type of device. These devices are not suited for dispensing thick fluids with dense pads because a thick fluid cannot penetrate (flow through) a dense pad.

The second type of device contains a nozzle that sprays the fluid onto the surface to be treated (the body, a surface to be cleaned, etc.) when a trigger is pulled. The device contains an integral pad that is perpendicular to the direction the fluid is sprayed. The pad is then used to rub the liquid on the surface. Examples of this second type of device include Schultz et al., U.S. Pat. No. 6,742,951, Jun. 1, 2004; and Beard, U.S. Pat. Appln. Publn. No. 2004/0101347, May 27, 2004. These devices are not suited for applying a fluid to a hard-to-reach part of the body because the nozzle must be positioned adjacent the surface and then the trigger must be pulled.

None of the prior art devices holds a large quantity of thick lotion, dispenses a controlled amount of the lotion with a displacement pump, and dispenses the lotion directly onto the exterior surface of a pad. Accordingly, a demand exists for an improved lotion dispenser-applicator that holds a greater quantity of lotion, that dispenses a controlled amount of lotion with a displacement pump, and that dispenses the lotion directly onto the exterior surface of a pad.

SUMMARY OF THE INVENTION

The general object of this invention is to provide an improved lotion dispenser-applicator. More particular objects are to provide a lotion dispenser-applicator that holds a greater quantity of lotion, that dispenses a controlled amount of the lotion with a displacement pump and that dispenses the lotion directly onto the exterior surface of a pad.

I have invented an improved lotion dispenser-applicator for dispensing and then applying a lotion to a body. The apparatus comprises: (a) an elongated handle having an interior reservoir for holding lotion, the handle having an upper end and a lower end and defining a vertical axis; (b) a planar face positioned at the upper end of the handle, the face having an exterior surface and a slot; (c) a porous pad covering the exterior surface of the face, the pad having a thickness, an exterior surface, and a void extending from the slot of the face to the exterior surface of the pad, the void defining an inner edge of the pad; (d) a depressible displacement pump connected to the upper end of the handle; (e) a dip tube connected to the pump that extends downwardly into the handle; and (f) a dispensing spout connected to the pump, the spout being about perpendicular to the vertical axis of the handle and having a distal end that extends into the void of the pad, the distal end of the spout having an orifice directed at an intersection formed by the inner edge and exterior surface of the pad when the pump is depressed. When lotion is dispensed from the orifice of the spout, it flows onto the exterior surface of the pad from which it is then applied to the body.

The lotion dispenser-applicator of this invention holds a large quantity of lotion so refilling is needed less frequently. The lotion dispenser-applicator dispenses an identical amount of lotion each time the pump is depressed so the user obtains exactly the desired amount of lotion on the applicator. The lotion is dispensed onto the exterior surface of the porous pad.

DETAILED DESCRIPTION OF THE INVENTION

Figure 1:
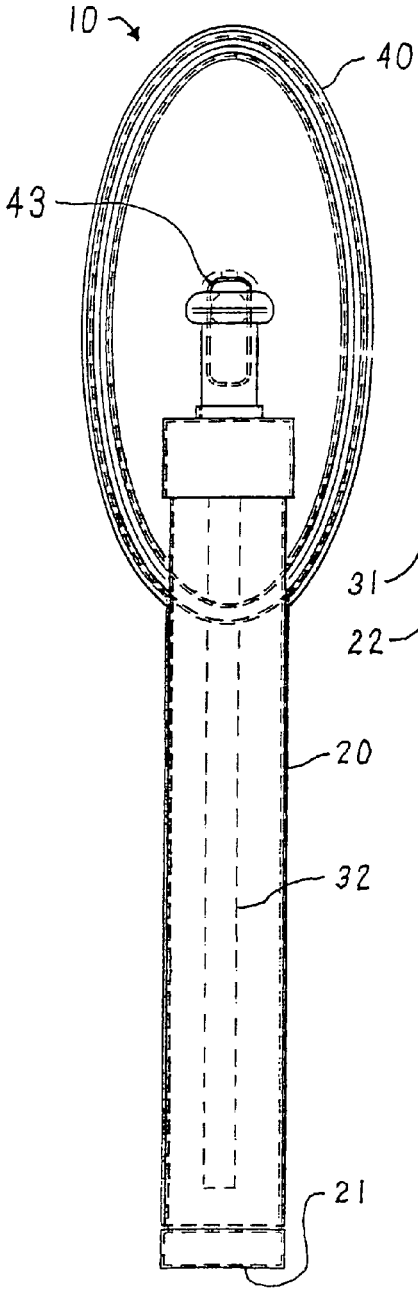
FIG. 1 is a front elevation view of a preferred embodiment of the lotion dispenser-applicator of this invention.

This invention is best understood by reference to the drawings. The lotion dispenser-applicator 10 of this invention is shown in FIGS. 1 to 5. The apparatus comprises a handle 20, a pump 30, a face 40, and a porous pad 50. The apparatus dispenses and applies a lotion 60. The components are discussed in more detail below.

The handle 20 is an elongated tube that also serves as the reservoir for the lotion. The handle is about one-half to two inches in diameter and is preferably about one inch in diameter. It is about six to twenty-four inches in length and is preferably about eight inches in length. The handle is preferably made of plastic and is most preferably made of a clear plastic such as polyethylene or the like so that the amount of lotion in the handle can be seen. The term "clear" includes transparent and translucent materials. This enables the user to know when the reservoir should be refilled. The handle contains a threaded sealable opening 21 at its lower end for refilling.

The pump 30 is connected to the upper end 22 of the handle. The pump includes a threaded collar 31 or other suitable means to seal the upper end of the handle. The pump is preferably a conventional displacement type pump having a reciprocating head and an internal cavity with a spring that biases the head in an extended position. A dip tube 32 (not shown in FIGS. 2 and 3 for clarity) extends from the pump downwardly inside the handle to a point near the bottom of the handle. The head of the pump includes a dispensing spout 33. The dispensing spout extends outwardly about perpendicularly to the longitudinal axis of the handle. The distal end of the spout contains an orifice 34 through which the lotion is dispensed. When the dispenser head is depressed, the volume of the internal cavity is reduced and a corresponding volume of lotion is forced out of the orifice in the spout. When the head is released, the suction created draws a corresponding volume of lotion upward into the dip tube. Thus, a displacement pump dispenses a controlled volume of lotion with each full depression of the head.

Figure 2:
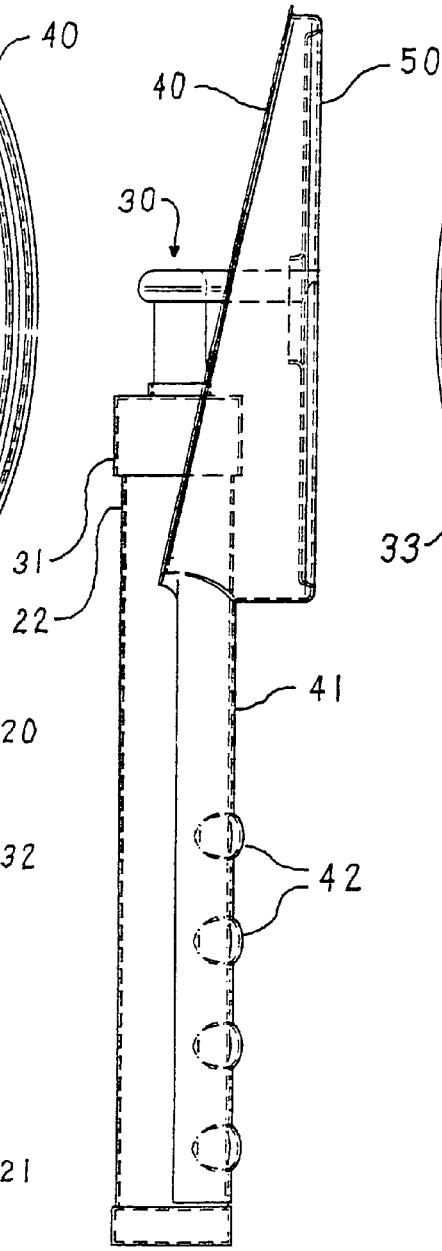
FIG. 2 is a side elevation view thereof.
Figure 3:
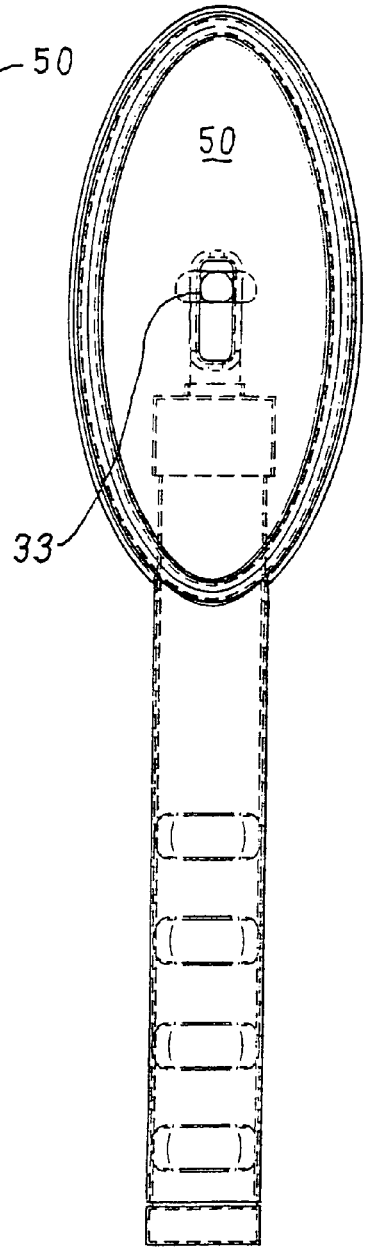
FIG. 3 is a rear elevation view thereof.

The face 40 is positioned at the upper end of the handle. The face serves as the support for the porous pad. In the preferred embodiment, the face contains a partial sleeve 41 that overlaps a portion of the handle. The sleeve contains indentations or protrusions 42 to aid in gripping. The sleeve is attached to the handle by adhesive. As seen in FIG. 2, the rear (interior) of the face may contain an enclosing wall that angles back from top to bottom. Alternatively, the wall may be relatively straight. The open back of the face enables the user to reach and depress the dispenser head. The front (exterior) of the face is generally planar and is preferably oval in shape. The face preferably has a width of about three inches, a depth of about one and one-half inches (including the enclosing wall), and a height of about six inches. The face is preferably made of plastic such as high density polyethylene.

The front surface of the face is generally about parallel to the longitudinal axis of the handle. In the embodiment shown in FIGS. 4 and 5, the exterior of the face slightly forward relative to the longitudinal axis of the handle so that the dispenser head extends outward a little more relative to the face as the pump is depressed. In other words, the top of the face is located further away from the longitudinal axis of the handle than the bottom of the face. A small opening 43 is present in the face to accommodate the dispensing spout throughout its range of movement. The small opening is preferably a rectangular slot.

The porous pad 50 covers the front (exterior) of the face. The porous pad is made of a material that is suitable for contact with the skin and that adheres well to the lotion. Suitable materials include fabric, natural foam such as sponge, or synthetic foam. The most preferred material is a relatively dense closed-cell polyurethane foam having a thickness of about three-eighths inch. The pad contains a void 51 that conforms to the shape of the opening in the face. The void creates an inner edge 52 of the pad. As explained in detail below, the dispensing spout moves within the void and the lotion is dispensed at the intersection 53 of the inner edge and exterior surface of the pad. The outer, exterior surface of the porous pad thus extends outward just past the dispensing spout so that the spout does not contact the body.

Figure 4:
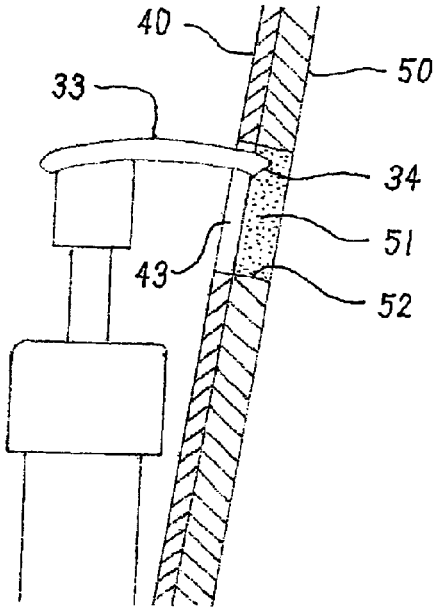
FIG. 4 is a partial section detailed side elevation view showing a first position.
Figure 5:
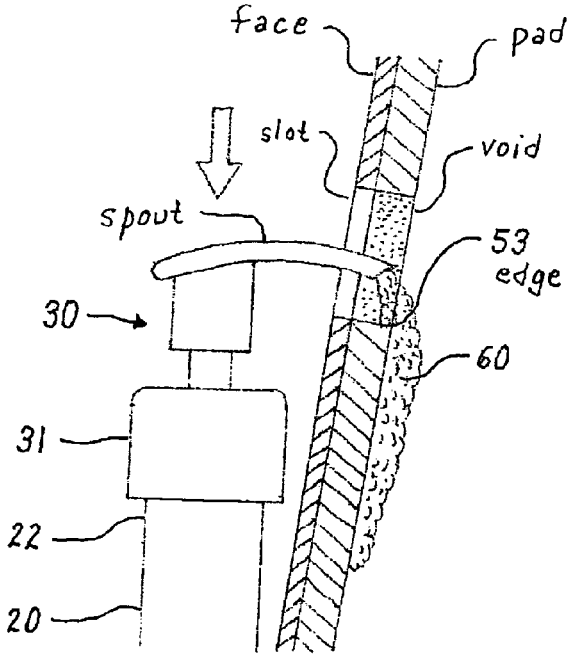
FIG. 5 is a partial section detailed side elevation view showing a second position.

The use of the lotion dispenser-applicator can now be considered. Before its initial use, the handle/reservoir is filled with lotion and the dispenser head is depressed and released several times to fill the dip tube and internal cavity with foam. The lotion dispenser-applicator is then ready for use. The dispenser head is depressed to dispense a controlled amount of lotion. Referring to FIGS. 4 and 5, the dispensing of lotion from the orifice of the dispensing spout is shown in detail. When the head is depressed as shown in FIG. 5, the orifice is directed at the intersection of the inner edge and the exterior face of the pad. The lotion 60 thus flows out of the void and down the exterior surface of the pad. The lotion dispenser-applicator is then held by the handle and the porous pad containing the lotion is applied to the desired part of the body.

The lotion dispenser-applicator is especially useful in applying soaps, moisturizers, creams, sunscreens, gels, and the like to parts of the body that are hard to reach. However, the lotion dispenser-applicator is also useful in applying other types of soaps, cleaners, conditioners, and the like to other surfaces. For example, the lotion dispenser-applicator is useful in applying cleaners and conditioners to hard-to-reach surfaces in automobiles, boats, and in the home.

I claim:

1. A lotion dispenser-applicator for dispensing and then applying a lotion to a body, the lotion dispenser-applicator comprising:

(a) an elongated handle having an interior reservoir for holding lotion, the handle having an upper end and a lower end;

(b) a head positioned at the upper end of the handle, the head comprising a face having an exterior surface and a slot;

(c) a porous pad covering the exterior surface of the face, the pad having an interior surface contacting the exterior surface of the face, an exterior surface defining a plane, a thickness, and a void aligned with the slot of the face, the void extending from the interior surface to the exterior surface of the pad, the void defining a continuous inner wall that extends from the interior surface to the exterior surface, the void further defining an outer edge formed by inner wall and the exterior surface;

(d) a depressible displacement pump connected to the upper end of the handle;

(e) a dip tube connected to the pump that extends downwardly into the handle; and (f) a dispensing spout connected to the pump, the spout being about perpendicular to the handle and having a distal end that extends outwardly through the slot in the face and into the void of the pad but not past the plane defined by the exterior surface of the pad, the distal end of the spout having an orifice directed obliquely relative to the exterior surface and in close proximity to the outer edge when the pump is depressed such that lotion dispensed from the orifice of the spout flows directly onto the outer edge and the exterior surface of the pad from which it is then applied to the body.

2. The lotion dispenser-applicator of claim 1 wherein the handle is about six to twenty-four inches in length and is made of a clear plastic.

3. The lotion dispenser-applicator of claim 2 wherein the pump contains a threaded collar for sealing the open end of the handle.

4. The lotion dispenser-applicator of claim 3 wherein the exterior surface of the face contains a front surface that angles forward relative to the pump.

5. The lotion dispenser-applicator of claim 4 wherein the porous pad is made of a synthetic foam.

* * * * *